US006623027B1

(12) United States Patent
Wheeler

(10) Patent No.: US 6,623,027 B1
(45) **Date of Patent: *Sep. 23, 2003**

(54) RELEASE BINDING AND BRAKE FOR TELEMARK AND CROSS-COUNTRY SKIS

(76) Inventor: Bryce Wheeler, P.O. Box 3802, Mammoth Lakes, CA (US) 93546

( * ) Notice: Subject to any disclaimer, the term of this patent is extended or adjusted under 35 U.S.C. 154(b) by 0 days.

This patent is subject to a terminal disclaimer.

(21) Appl. No.: 09/995,454

(22) Filed: Nov. 27, 2001

Related U.S. Application Data

(63) Continuation-in-part of application No. 09/094,880, filed on Jun. 15, 1998, now Pat. No. 6,092,830, and a continuation-in-part of application No. 09/566,929, filed on May 8, 2000, now Pat. No. 6,322,095.

(51) Int. Cl.[7] ..... A63C 9/08

(52) U.S. Cl. ..... 280/623; 280/613; 280/634; 280/604

(58) Field of Search ..... 280/14.21, 14.22, 280/604, 613, 615, 623, 624, 633, 634, 636, 637; 279/24, 79

(56) References Cited

U.S. PATENT DOCUMENTS

| | | | | | |
|---|---|---|---|---|---|
| 1,809,237 | A | * | 6/1931 | Halborg | 279/79 |
| 1,938,860 | A | * | 12/1933 | Renfer | 279/79 |
| 3,775,866 | A | * | 12/1973 | Marker | 280/615 |
| 3,931,980 | A | * | 1/1976 | Marker | 280/623 |
| 3,950,000 | A | * | 4/1976 | Sittmann | 280/636 |
| 4,185,851 | A | * | 1/1980 | Salomon | 280/613 |
| 4,231,584 | A | * | 11/1980 | Kikuchi | 280/604 |
| 4,792,156 | A | * | 12/1988 | Hue | 280/615 |
| 5,069,463 | A | * | 12/1991 | Baud et al. | 280/636 |
| 5,076,604 | A | * | 12/1991 | Wittmann et al. | 280/633 |
| 5,481,949 | A | * | 1/1996 | Yen | 279/79 |
| 5,595,396 | A | * | 1/1997 | Bourdeau | 280/613 |
| 5,823,563 | A | * | 10/1998 | Dubuque | 280/615 |
| 5,913,530 | A | * | 6/1999 | Berger et al. | 280/613 |
| 6,336,650 | B1 | * | 1/2002 | Alspaugh | 280/613 |

FOREIGN PATENT DOCUMENTS

| | | | | |
|---|---|---|---|---|
| FR | 2363344 | * | 3/1978 | 280/613 |
| WO | 86/06290 | * | 11/1986 | 280/613 |

* cited by examiner

*Primary Examiner*—Frank Vanaman
(74) *Attorney, Agent, or Firm*—Timothy Thut Tyson; Ted Masters; Freilich, Hornbaker & Rosen

(57) ABSTRACT

A release binding is shown for releasably attaching a ski boot to a telemark or cross-country ski having a load spool with a circumferential groove and a substantially elliptical holding portion attached perpendicular to the bottom of a toe plate. A release plate having a load spring with two sides is attached to the ski. To assemble the boot on the ski, a lever is moved to an unlocked position placing the minor axis of the ellipse of the load spool perpendicular to the two sides of the spring. After the boot is assembled to the ski, the lever is moved to a locked position which moves the major axis of the ellipse of the spool until it is perpendicular to the sides of the spring.

7 Claims, 4 Drawing Sheets

FIG. 2
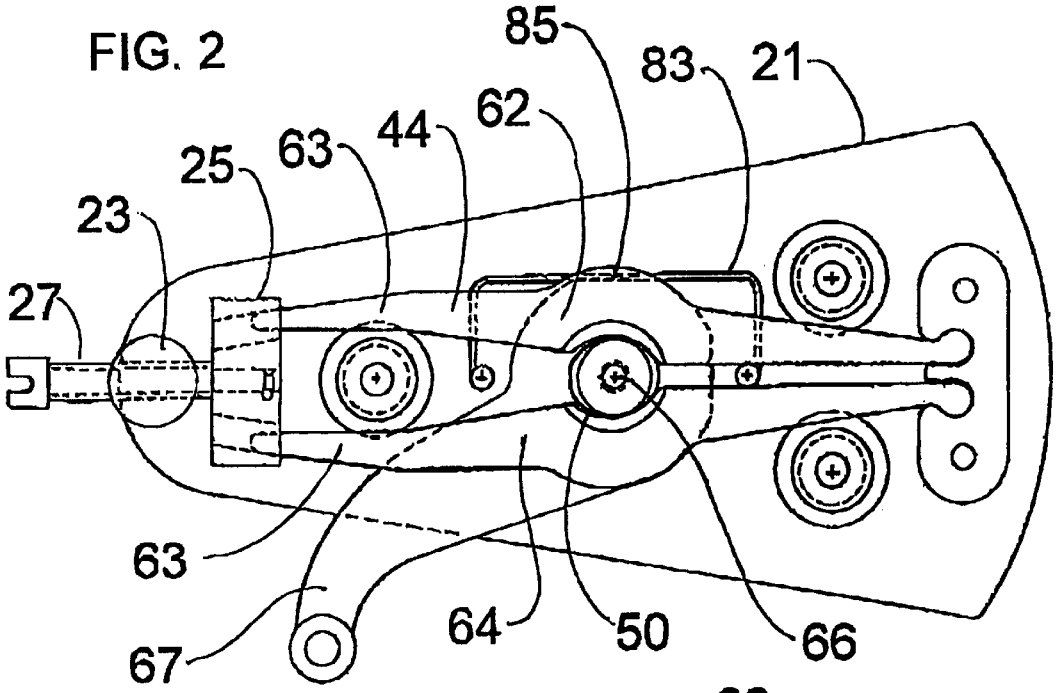
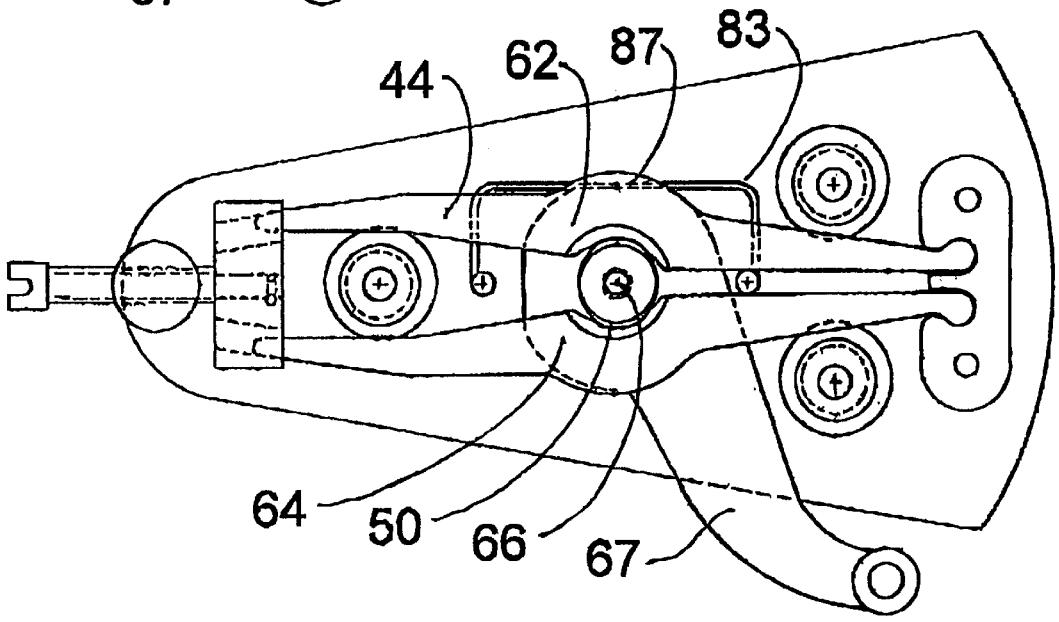
FIG. 3

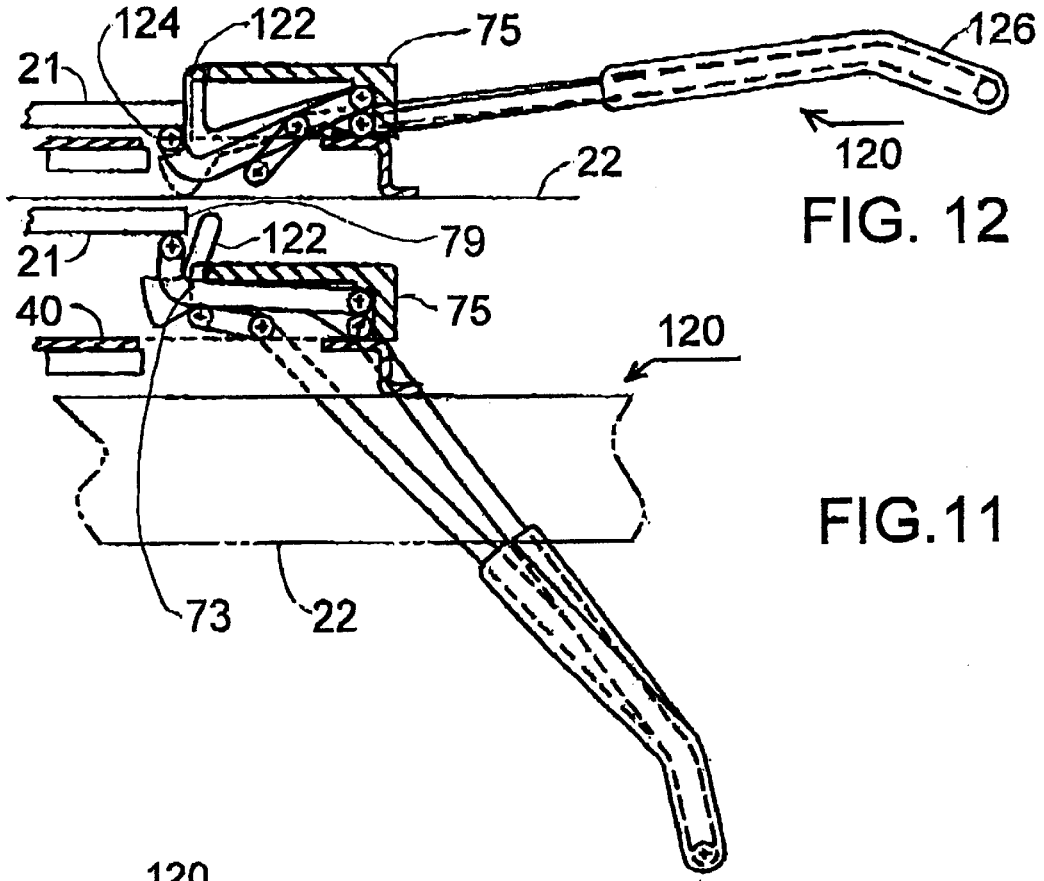
FIG. 12
FIG.11
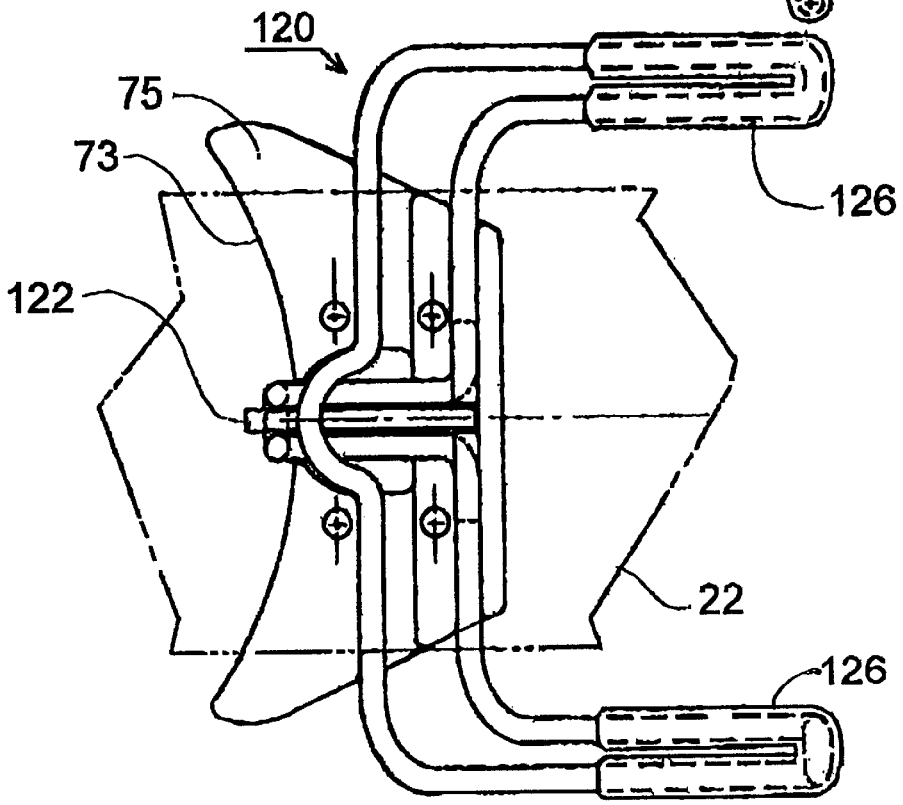
FIG.10

RELEASE BINDING AND BRAKE FOR TELEMARK AND CROSS-COUNTRY SKIS

CROSS REFERENCE TO RELATED APPLICATIONS

This application is a continuation-in-part of application Ser. No. 09/094,880, filed Jun. 15, 1998, now U.S. Pat. No. 6,092,830, issued Jul. 25, 2000, and application Ser. No. 09/566,929, filed May 8, 2000, now U.S. Pat. No. 6,322,095, issued Nov. 27, 2001, which are incorporated herein by reference.

TECHNICAL FIELD

The present invention relates generally to the field of skis, and more particularly to a release binding and brake for telemark and cross-country skis.

BACKGROUND ART

Ski release bindings for skis are well known in the art such as shown in U.S. Pat. Nos. 3,877,712; 4,348,036; 4,621,828; 4,348,036; and 5,518,264. The most widely used telemark release binding uses a cable around the heel of the boot. Ski bindings that are easier to use and provide greater safety would enhance the enjoyment of the sport.

Ski brakes are also well known in the art and have substantially supplanted the use of tethers between skis and skiers. Typically the brakes are spring activated to project pawls nominally downward below the bottoms of the skis to engage the snow. They are disengaged when the skiers step on their tops with their boots swinging the pawls up along the sides of the skis. This spring style of brake has not been adapted to telemark and cross-county skis because the heels of the boots are not fixed.

DISCLOSURE OF INVENTION

The present invention is directed to an improved release binding and brake for telemark and cross-country skis. Instead of fastening the toe plate directly to the ski, a release plate is positioned between a toe plate and the ski. Inside the release plate is a planar load spring having two sides forming an elongated central aperture which is accessible through a top hole. In U.S. Pat. Nos. 6,092,830 and 6,322,095 by applicant, a load spool having a circumferential groove is attached to the bottom of the toe plate. To install the toe plate on the ski, the skier positions the load spool in the hole in the release plate and pushes down with his weight to engage the groove of the load spool in the spring and hold the toe plate to the ski.

In the present preferred embodiment of the invention, the cross section of the holding portion of the load spool is substantially elliptical, not cylindrical, and is rotatable by means of a lever extending outside the toe plate. When the skier wants to step into the spring to engage the ski on/the spool, the force required is minimized by moving the lever to rotate the spool so that the minor axis of the ellipse is perpendicular to the two sides of the spring. When the skier want to ski, the force required to pull the spool out of the spring is maximized by using the lever to rotate the spool so that the major axis of the ellipse is perpendicular to the two sides of the spring.

In accordance with an important aspect of the invention, the step in force is substantially 70 percent of the weight of the skier while the pullout force is substantially 250 percent of the weight of the skier.

In accordance with another preferred embodiment, a spring type brake is positioned under the toe plate. The position of the brake is determined entirely by the presence or absence of the toe plate. If the toe plate is present, the top of the spring brake is down forcing the pawls of the brake up. If the toe plate is absent, the spring activates forcing the pawls of the brake down to engage the snow and stop the ski.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 2 is top plan view of the lever, spool, and spring in the unlocked position with respect to the adapter plate;

FIG. 3 is similar to FIG. 2 with the lever, spool and spring in the locked position;

FIG. 10 is a top plan view of the brake in a deployed position;

FIG. 11 is a sectional view of the brake of FIG. 10 along the center line; and, FIG. 12 is a sectional view similar to FIG. 11 with the brake in a stowed position.

MODES FOR CARRYING OUT THE INVENTION

Figure 1:
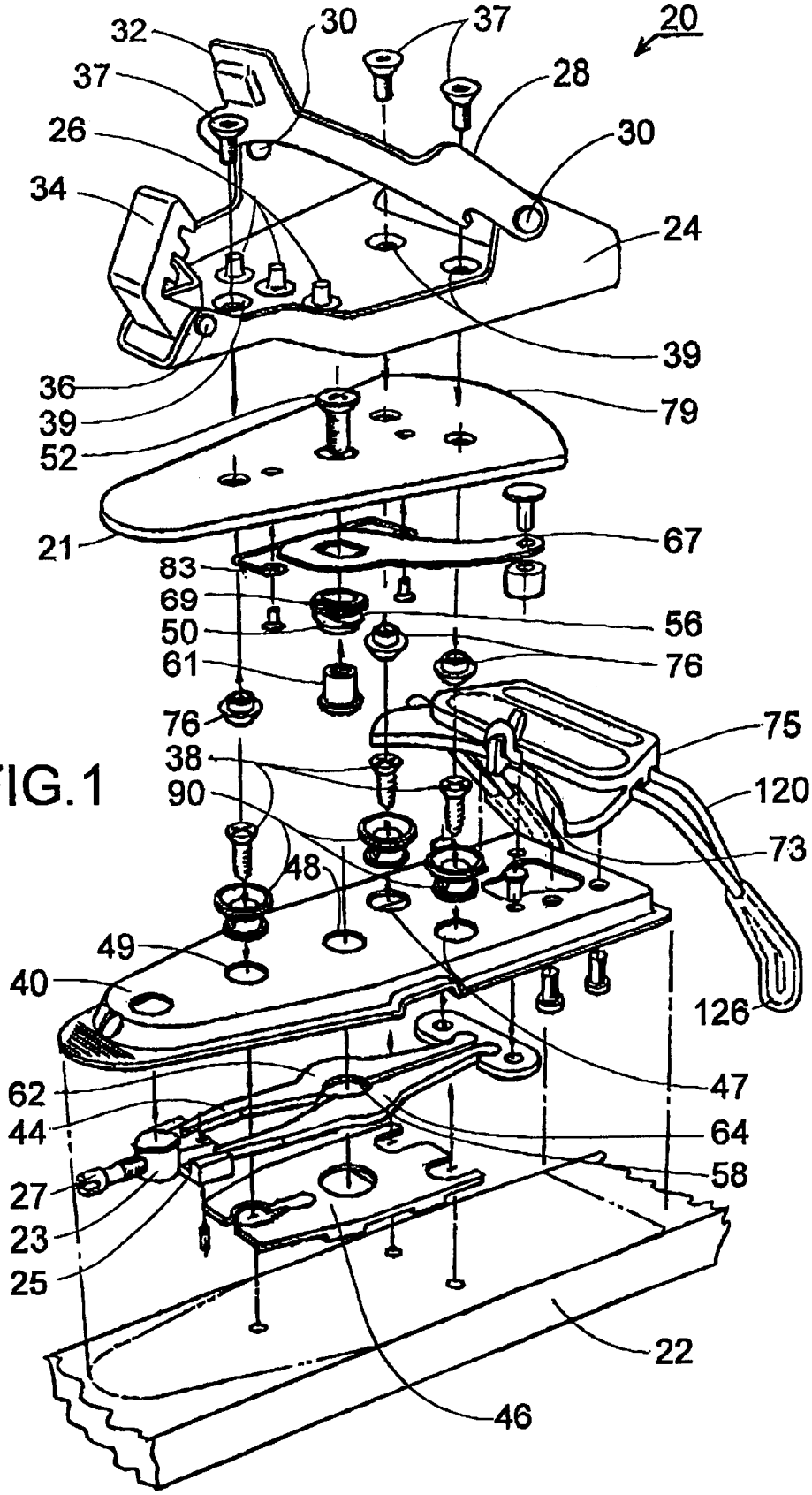
FIG. 1 is an exploded top front left side perspective view of a release binding and brake in accordance with the present invention above a central portion of a ski.

Referring initially to FIG. 1, there is illustrated an exploded top front left side perspective view of a release binding and brake in accordance with the present invention, generally designated as 20, above a central portion of a cross-country or telemark ski 22. Toe plate 24 has a standard three pin telemark mount for use with a boot having three pin holes in its toe. After the toe of the boot is inserted on the three pins 26, clamp 28 is rotated down around rivets 30 against the flange of the toe of the boot until tongue 32 engages catch 34 which is mounted on axle 36 thereby securing the boot on the toe plate 24 in a manner well known in the art. Toe plate 24 is a commonly available toe plate which is usually attached directly to the ski by wood screws through the three mounting holes 39.

In the present embodiment, an adapter plate 21 and release plate 40 are positioned between the toe plate 24 and the ski 22. The adapter plate allows the standard toe plate to be used without modification. The toe plate 24 is attached to the adapter plate by machine screws 37 passing through the mounting holes 39 in the toe plate into conical guides 76. A load spool 50 is rotatably secured perpendicular to the bottom of the adapter plate 21 on a fixed shaft 61 held by a machine screw 52. Adapter plate 21 has a rearward facing first contour 79. The release plate 40 is attached to the ski 22 by wood screws 38 passing through cone seats 90 fitted in holes 47 and 49. The cone seats 90 register with the conical guides 76 to facilitate positioning of the adapter plate 21 on the release plate 40. A center pad 75 coupled to release plate 40 further aids in the positioning process by providing a forward facing second contour 73 which is shaped and dimensioned to fit first contour 79 of adapter plate 21 to align it with release plate 40.

When the skier wants to install the toe plate 24 on the ski 22, he first clamps his boot in the toe plate in the manner described above. He then inserts the load spool 50 into the hole 48 in the release plate 40 and steps down against a load spring 44. In the process, the load spool pushes apart the two sides 62 and 64 of the load spring 44 allowing the load spool to pass through the spring. The sides of the spring then resiliently snap into the circumferential groove 56 of the load spool 50 to retain the toe plate 24 on the ski 22. The force required to push the load spool into the spring is dependent upon the strength of the spring and the shape of the spool.

The two opposing sides 62 and 64 of the load spring 44 are coupled together at both ends defining an elongated central aperture. When the spool is inserted, each side displaces equally. When the spring is unflexed as shown in FIG. 1, the two opposing sides in the engagement area 58 are spaced a distance less than the diameter 59 of the circumferential groove 56. An adjuster 23 is provided for selectively changing the distance between the two sides 62 and 64. As the screw 27 is turned out, it pulls translating yoke 25 away from the engagement area 58 moving the sides 62 and 64 away from each other thereby lessening the force required to push the load spool into position or pull it out. As the screw 27 is turned in, it pushes translating yoke 25 toward the engagement area 58 moving the sides 62 and 64 toward each other thereby increasing the force required to push the load spool into position or pull it out. The operation of the adjuster feature is fully described in U.S. Pat. No. 6,322,095. A spacer plate 46 keeps spring 44 in place inside release plate 40 and provides clearance for the load spool when it is in position.

In the previous versions of the release binding described in U.S. Pat. Nos. 6,092,830 and 6,322,095, the spool is substantially cylindrical having a circumferential groove around the diameter for accepting and holding the two sides of the spring. This means that for any given adjustment of the adjuster, the force required to push a given load spool in or pull it out remains the same. If the force is increased sufficiently to meet the demands of aggressive skiers such as telemark skiers, the force required to initially assemble the release binding can become unacceptable. On the other hand, if the force is decreased to make the assembly easy, the force required to pull the spool out of the spring may be unacceptably low thereby limiting possible skiing maneuvers and even causing dangerous situations where the ski becomes inadvertently unattached.

In the improved embodiment of the present invention, the holding portion of the load spool 50 is not cylindrical. Instead it has a substantially elliptical cross section outside the circumferential groove having minor and major axes. The fixed shaft 61 allows the spool to be rotated to place either the minor axis or major axis perpendicular to the two sides 62 and 64 of the spring as desired. When the minor axis is perpendicular to the sides of the spring, the force required to push the spool into or pull it out of the spring is lower than when the major axis is perpendicular to the sides of the spring for a given adjustment of the spring. A lever 67 is provided for rotating the spool 90° between the two positions. In this manner, the force needed to assemble and disassemble the release binding can be adjusted between two disparate levels quickly. For example in one embodiment of the elliptical spool, the minor axis of the ellipse allows the step-in or assembly force to be less than 70% of the weight of the skier while rotation to the major axis of the ellipse requires a pullout force of 250% or more of the weight of the same skier.

FIG. 2 is top plan view of the lever 67, spool 50, and spring 44, and adapter plate 21 in the unlocked position with the minor axis of the elliptical spool perpendicular to the two sides 62 and 64 of the spring. A wire detent spring 83 operates against a detent flat 85 of the lever to hold it in the unlocked position. The configuration of the adjuster 23 can be clearly seen with the screw 27 positioned to push or pull the translating yoke 25 in relation to the ends 63 of the spring 44 to adjust the tension provided by the spring.

FIG. 3 is similar to FIG. 2 with the lever 67, spool 50, and spring 44 in the locked position with the major axis of the elliptical spool perpendicular to the two sides 62 and 64 of the spring. The wire detent spring 83 operates against a decent flat 87 of the lever to hold it in the locked position. Detent flats 85 and 87 are both perpendicular to the longitudinal axis 66 of the load spool 50 and are substantially 90° in relation to each other.

Figure 5:
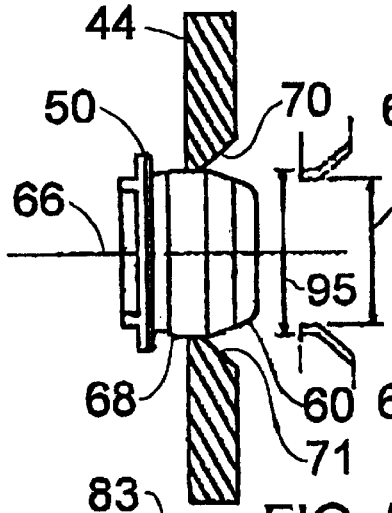
FIG. 5 is a rear elevation view of the spool of FIG. 4 in a cross section of the spring.
Figure 4:
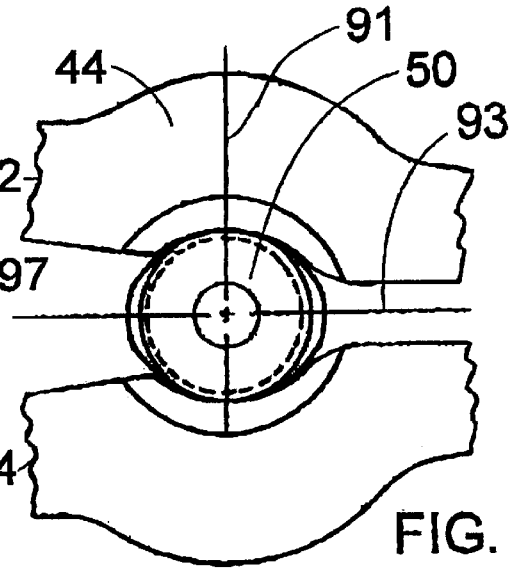
FIG. 4 is an enlarged top plan view of the spool and spring of FIG. 2.

FIG. 4 is an enlarged top plan view of the spool 50 and spring 44 of FIG. 2. FIG. 5 is a rear elevation view of the spool 50 of FIG. 4 with a cross section of the spring 44. The spool is being pushed into the spring with the spool in an unlocked position having the minor axis 91 substantially perpendicular to the sides 62 and 64 and the major axis 93 substantially parallel to the sides 62 and 64. In the position shown, the spring is in its maximum deflection position from its at rest positions represented by distances 95 and 97 shown in phantom to the right. The rest positions are determined by the adjuster 23. When the screw 27 is turned out to the lowest setting, the sides of the spring at the load spool are separated by the distance 95. When the screw 27 is turned in to the highest setting, the sides of the spring at the load spool are separated by the distance 97. The pilot surface 60 is tapered to a diameter smaller than the smallest possible distance 95 between the sides of the spring in order to smoothly begin the pushing apart process.

Figure 7:
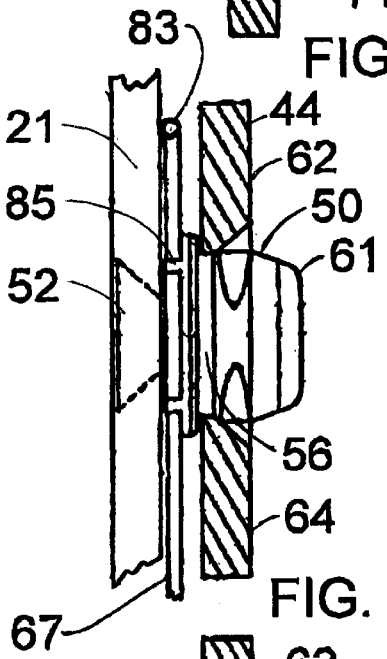
FIG. 7 is a rear elevation view of the spool of FIG. 6 in a cross section of the spring.
Figure 6:
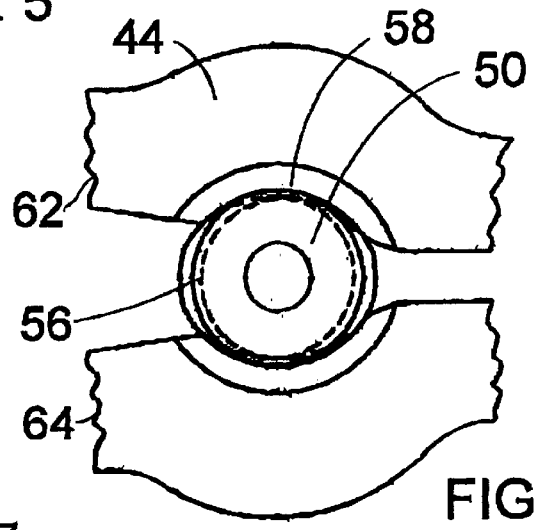
FIG. 6 is similar to FIG. 4 with the spool pushed down to the adapter plate.

FIG. 6 is similar to FIG. 4 with the spool 50 pushed down to the snap-in holding position. FIG. 7 is a rear elevation view of the spool 50 of FIG. 6. The sides of the spring 62 and 64 are in the circumferential groove 56. The circumferential groove of the load spool has a downward sloped bottom side 68 which can best be seen in FIG. 5 preferably at 45° to the longitudinal axis 66 of the spool. The sides 62 and 64 of the spring have upward slopes 70 and 71 preferably at substantially 45° to the longitudinal axis 66 of the spool. When the spring squeezes the spool in the horizontal plane, the force pushes upward slopes 70 and 71 against downward slope 68 pulling the spool down until the edges of the spring abut the bottom of the circumferential groove.

The spool is rotatable on a fixed shaft 61 attached to the adapter plate 21 by the machine screw 52. The lever 67 is positioned between the rotatable portion of the spool and the adapter plate 21. The wire detent spring 83 operates against the detent flat 85 to keep the spool from inadvertently rotating.

Figure 9:
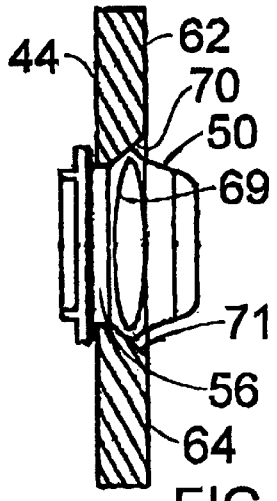
FIG. 9 is a rear elevation view of the spool of FIG. 8 in a cross section of the spring.
Figure 8:
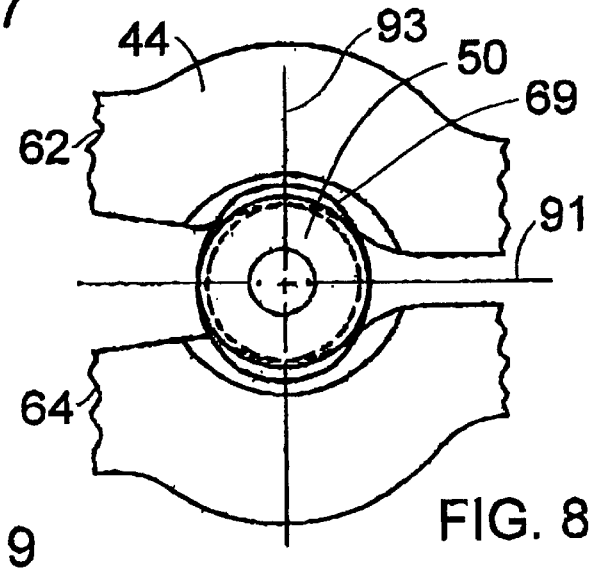
FIG. 8 is similar to FIG. 4 with the spool rotated 90 degrees to a locked position.

FIG. 8 is similar to FIG. 4 with the spool 50 rotated 90 degrees by the lever 67 to the locked position of FIG. 3. FIG. 9 is a rear elevation view of the spool 50 of FIG. 8 in a cross section of the spring. The sides 62 and 64 of the spring 44 have not moved in the rotation process because the bottom of the circumferential groove 56 is circular. But the major axis 93 of the elliptical holding portion 69 of the spool has moved under the upward slopes 70 and 71 of the spring sides 62 and 64. As can be readily appreciated, much more force is required to pull the spool 50 to the left out of the spring 44 shown in FIG. 9 than is required to pull the spool to the left out of the spring shown in FIG. 7.

It will be appreciated that which the cross section of the holding portion 69 of the load spool 50 is described as being substantially elliptical with minor and major axes 91 and 93, respectively, it does not have to be truly elliptical and is not as seen in FIGS. 4, 6, and 8. All that is required is that the holding surface presented along the major axis 93 be further from the longitudinal axis 66 of the load spool than the holding surface presented along the minor axis. The outermost edge of the ellipse in FIGS. 4, 6, and 8 is truncated along the major axis in a curve matching the curve of the holding area 58 of the spring 44. Then when the load spool pulls out of the spring, it releases simultaneously along the whole curve. If it were a perfect ellipse, it would release only when the very tip of the ellipse passed the curve of the holding area which might result in breakage of either the tip or the holding area.

FIG. 10 is a top plan view of the spring brake of the present invention, generally designated 120, in a deployed position with the pawls 126 in a down position where they can engage the snow and stop the ski. It is similar to spring brakes found on downhill skis. But the brake of the present invention does not rely on a boot being secured at both the toe and heel as on a down hill ski binding because the heel of a cross-country or telemark boots must be allowed to move up away from the ski during the gliding action required to propel the ski forward. Instead the brake 120 of the present invention relies upon the presence of the adapter plate to hold it in a stowed position out of the snow. So long as the adapter plate is held on the ski 22, the brake is held in the stowed position. When the adapter plate 21 is released from the ski, the spring action of the brake immediately moves it to the deployed position shown in FIG. 10. The brake 120 is secured to the ski 22 at the center pad 75 in the middle of the ski which is approximately the same location of a spring brake on downhill skis. In addition to its braking function, the brake 120 of the present invention provides a guide 122 which aids in the positioning of the boot on the ski during the assembly process. As described above, the skier inserts the load spool in the spring by initially touching the back of the adapter plate against the forward facing second contour 73 of the center pad 75. The guide 122 helps keep the boot from moving out of position back over the center pad 75.

FIG. 11 is a sectional view of the brake 120 of FIG. 10 along the center line. The guide 122 helps the skier locate the adapter plate 21 in front of the center pad 75. The adapter plate 21 is positioned relative to the release plate 40 by placing the convexly curved first contour 79 of the adapter plate against the concavely curved forward facing second contour 73 of the center pad 75. The guide 122 rises further above the ski 22 than the center pad 75 when the brake is in the deployed position providing a physical barrier to the rearward movement of the skier's boot as he attempts to bind the boot to the ski. He can then move his boot down slightly until he feels the edge 73 of the center pad knowing that his boot is in the proper longitudinal position relative to the ski.

FIG. 12 is a sectional view similar to FIG. 11 with the brake 120 in the stowed position on the ski 22. When the adapter plate 21 is pushed down, it engages the retract lever 124 of the brake pushing the front of the brake down with the guide 122 until the boot rests on the center pad 75. In the process, the pawl 126 is lifted above the snow.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A release binding for mounting a boot to a ski, comprising:

a toe plate for retaining the toe of the boot having a substantially planar bottom surface;

a load spool having a longitudinal axis and a substantially elliptical exterior surface having major and minor axes substantially perpendicular to said longitudinal axis and a circumferential groove with a diameter less than said minor axis;

said load spool rotatably coupled to said bottom surface of said toe plate with said longitudinal axis perpendicular to said planar bottom surface;

a planar load spring having two sides coupled together at both ends defining an elongated central aperture, said two sides spaced from each other in an engagement area when in an unflexed condition a distance less than said diameter of said circumferential groove;

said engagement area of said load spring two sides gripping said load spool in said groove; and, a release plate for mounting said release binding on the ski and retaining said load spring with the plane of said load spring perpendicular to said longitudinal axis of said load spool.

2. A release binding according to claim 1, further including a lever coupled to said rotatable load spool for rotating said load spool from a position where said minor axis is substantially perpendicular to said two sides of said spring to a position where said major axis is substantially perpendicular to said two sides of said spring and vice versa.

3. A release binding according to claim 2, further including a spring detent and said rotatable load spool having two detent flats perpendicular to said longitudinal axis of said load spool and at substantially 90° to each other defining locked and unlocked positions whereby said spring detent keeps said load spool at said locked position or said unlocked position until said lever moves it to the other of said locked position or said unlocked position.

4. A release binding according to claim 1, further including a spring activated brake for positioning between said toe plate and the ski whereby the brake is in a stowed position when said load spool engages said load spring and said brake is in a deployed position when said load spool does not engage said load spring.

5. A release binding according to claim 4, further including said spring activated brake having a guide for guiding the placement of said load spool to engage said load spring.

6. A release binding for mounting a boot to a ski, comprising:

a toe plate for retaining the toe of the boot having a substantially planar bottom surface;

a load spool having a longitudinal axis and a circumferential groove;

said load spool coupled to said bottom surface of said toe plate with said longitudinal axis substantially perpendicular to said planar bottom surface;

a planar load spring having two sides coupled together at both ends defining an elongated central aperture, said two sides spaced from each other in an engagement area when in an unflexed condition a distance less than said diameter of said circumferential groove;

said engagement area of said load spring two sides gripping said load spool in said groove;

a release plate for mounting said release binding on the ski and retaining said load spring with the plane of said load spring perpendicular to said longitudinal axis of said load spool; and, a spring activated brake for positioning between said toe plate and the ski whereby said brake is in a stowed position when said load spool engages said load spring and said brake is in a deployed position when said load spool does not engage said load spring.

7. A release binding according to claim 6, further including said spring activated brake having a guide for guiding the placement of said load spool to engage said load spring.

* * * * *